US007021214B2

(12) United States Patent
Kugo et al.

(10) Patent No.: US 7,021,214 B2
(45) Date of Patent: Apr. 4, 2006

(54) METHOD FOR ISSUING LABEL WITH THERMOSENSITIVE ADHESIVE

(75) Inventors: Tomoyuki Kugo, Numazu (JP); Hiroshi Goto, Fuji (JP); Toshiaki Ikeda, Shizuoka-ken (JP); Norihiko Inaba, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 25 days.

(21) Appl. No.: 10/763,850

(22) Filed: Jan. 23, 2004

(65) Prior Publication Data

US 2004/0163556 A1 Aug. 26, 2004

(30) Foreign Application Priority Data

Jan. 27, 2003 (JP) ..... 2003-018050
Dec. 16, 2003 (JP) ..... 2003-418571

(51) Int. Cl.
*B41F 13/54* (2006.01)
*B65C 9/18* (2006.01)
*B65C 9/44* (2006.01)

(52) U.S. Cl. ..... 101/485; 101/481; 101/484; 156/353; 156/378; 156/384

(58) Field of Classification Search ..... 101/481, 101/484, 485, 486, DIG. 36; 400/120.01, 400/120.18; 428/343, 346, 40; 347/171, 347/212; 156/353, 350, 361, 366, 378, 379, 156/379.6, 384
See application file for complete search history.

(56) References Cited

U.S. PATENT DOCUMENTS

| | | | | |
|---|---|---|---|---|
| 3,891,324 | A * | 6/1975 | Davies | 356/615 |
| RE28,732 | E | 3/1976 | von Hofe | |
| 4,397,709 | A * | 8/1983 | Schwenzer | 156/351 |
| 4,519,868 | A | 5/1985 | Hoffmann | |
| 5,741,381 | A | 4/1998 | Dolence et al. | |
| 5,827,590 | A | 10/1998 | Morita et al. | |
| 5,853,117 | A | 12/1998 | Traise | |
| 6,210,054 | B1 * | 4/2001 | Adams et al. | 400/621 |
| 6,358,353 | B1 | 3/2002 | Maliner | |
| 6,500,536 | B1 | 12/2002 | Yamada et al. | |
| 6,501,495 | B1 | 12/2002 | Ichikawa et al. | |
| 2002/0043322 | A1 | 4/2002 | Shiraishi | |
| 2002/0064613 | A1 | 5/2002 | Kugo et al. | |
| 2003/0175507 | A1 | 9/2003 | Ikeda et al. | |

FOREIGN PATENT DOCUMENTS

EP 0 370 642 A1 5/1990

OTHER PUBLICATIONS

U.S. Appl. No. 10/229,450, filed Aug. 28, 2002.

* cited by examiner

*Primary Examiner*—Leslie J. Evanisko
(74) *Attorney, Agent, or Firm*—Cooper & Dunham LLP

(57) ABSTRACT

A method for issuing a label, including feeding a first label sheet including a support and a thermosensitive adhesive layer located overlying one side of the support, wherein the first label sheet has a timing mark on the thermosensitive adhesive layer; detecting the timing mark; and cutting or semi-cutting the first label sheet to produce a second label sheet, wherein the timing mark is present at a position other than corners of the second label sheet, and wherein a ratio of an area of the timing mark to an area of the second label sheet is from 0.5 to 35%.

12 Claims, 4 Drawing Sheets

METHOD FOR ISSUING LABEL WITH THERMOSENSITIVE ADHESIVE

BACKGROUND OF THE INVENTION

1. Field of the Invention

The present invention relates to a method for issuing a cut or semi-cut label with a thermosensitive adhesive layer on the backside thereof, and more particularly to a method in which a long sheet (such as a rolled sheet) of label with a thermosensitive adhesive layer and a timing mark on the backside thereof is cut or semi-cut while detecting the timing mark to issue a cut or semi-cut label.

2. Discussion of the Related Art

Cut labels are typically issued by the following method. At first, information such as name, weight and price of a good and a barcode is recorded in a predetermined position of a long sheet of label (typically a rolled label) using a printer (i.e., a label issuing device). Then the long sheet of label is cut to produce cut labels.

At the present time, long sheet of labels are broadly classified into two types. The first type of label is illustrated in FIGS. 1A and 1B. Referring to FIGS. 1A and 1B, a long label sheet 1 is constituted of a release paper 2 and plural label pieces 3. The plural label pieces 3 are arranged side by side on the release paper 2 (e.g., silicone-coated papers) at regular intervals (d). The label pieces 3 are constituted of a face paper (or a support) 31 and an adhesive layer 32 and are attached to the release paper 2 with the adhesive layer 32. When the long label sheet is cut into plural label pieces, a cutter provided in a printer cuts the long sheet of label at a line L. In this case, a sensor provided in the printer detects an area 4 utilizing the deference in light transmittance between an area of the release paper 2 on which the label piece 3 is present and the area 4 of the release paper 2 on which the label piece 3 is not present.

The second type of label, i.e., a label sheet with a thermosensitive adhesive layer on the backside thereof, is illustrated in FIGS. 2A to 2C. As illustrated in FIGS. 2A and 2B, a long label sheet 10 is typically constituted of a face paper (or a support) 11 and a thermosensitive adhesive layer 12. On the backside of the label 10 (i.e., on the adhesive layer 12), a so-called "eyemark" 13 (or an i-mark, hereinafter referred to as a timing mark) is printed at regular intervals. A sensor provided in a printer detects the timing mark 13 utilizing the difference in light transmittance between the timing mark and the other area of the label sheet 10, and a cutter provided in the printer cuts the label sheet 10 at a line L' to produce a label piece, i.e., a label piece 100 illustrated in FIG. 2D. Printing is typically performed on the surface of the face paper 11 by a printer on demand.

The thus prepared label piece 100 includes the timing mark 13 at a corner thereof. The timing marks 13 are typically formed on the thermosensitive adhesive layer 12. In this case, when the thermosensitive adhesive layer 12 is activated upon application of heat thereto, the area of the adhesive layer below the timing marks cannot be sufficiently activated. Therefore, when the label piece 100 is adhered to a good, the timing mark area is not adhered to the good, and thereby a problem in that entire or part of the label is peeled from the good is caused.

In attempting to solve this problem, techniques such that the density of the timing marks is decreased or the thickness of the timing marks is decreased have been proposed. By using such techniques, the adhesive force of the adhesive layer of the timing mark area can be improved to some extent. However, the techniques are often accompanied with problems in that the timing marks cannot be detected, i.e., the timing marks do not function.

In addition, a technique in that timing marks are formed between a thermosensitive adhesive layer and a face paper (i.e., a support) is proposed. In this case, the peeling problem can be avoided (i.e., the label can be well attached to a good). However, this technique has a drawback in that the size (length) of label sheets has to be predetermined when the face paper 11 is prepared, and therefore such a label cannot satisfy a need of large item small scale production.

In addition, it is possible that timing marks are formed on the surface of the face paper 11. However, the resultant label sheet (i.e., the cut label sheet) have a timing mark on the surface thereof. Namely, such label sheets have no commercial value.

Because of these reasons, a need exists for a label sheet having a thermosensitive adhesive layer, which can be cut at a predetermined position and which can be easily heat-activated, wherein the heat-activated label sheet can be adhered to a good without causing the peeling problem.

SUMMARY OF THE INVENTION

Accordingly, an object of the present invention is to provide a method for stably and efficiently issuing a cut label with a thermosensitive adhesive layer which can be easily heat-activated and which does not cause the peeling problem when adhered to a good.

To achieve such objects, the present invention contemplates the provision of a method for issuing a label, including:

feeding at a predetermined speed a first label sheet including a support and an adhesive layer located on the backside of the support, wherein the first label sheet has a timing mark on the adhesive layer;

detecting the timing mark; and cutting or semi-cutting the first label sheet to produce a second label sheet, wherein the timing mark is present at a location other than the corners of the second label sheet and wherein the ratio of the area of the timing mark to the area of the second label sheet is from 0.5 to 35%. In this regard, when the first label sheet is semi-cut (for example, perforated), the second label means a small label sheet intervened between two adjacent perforations.

It is preferable that the timing mark is at least 5 mm apart from the outer edge (particularly, from the side edges) of the second label sheet.

In addition, it is preferable that a thermosensitive recording layer is formed on a side of the first label sheet opposite that bearing the adhesive layer. In this case, it is preferable that the method further includes printing an image on the thermosensitive recording layer before the timing mark detection step, or at a time before the cutting or semi-cutting step and before the timing mark detection step.

It is preferable that the method further includes heat-activating the thermosensitive adhesive layer after the cutting or semi-cutting step.

In addition, it is preferable that the timing marks are printed on a side of the adhesive layer opposite that bearing the face material, using an ultraviolet crosslinking ink or an electron beam crosslinking ink.

The adhesive layer preferably includes a silicone-modified thermoplastic resin and a solid plasticizer.

It is preferable that the difference in light reflectivity between the timing mark area and the non-mark area is not less than 45% in a wavelength range of from 880 nm to 920 nm. The timing mark preferably includes a near-infrared absorbing colorant (dye or pigment) having an absorption property such that a maximum absorption peak is present at a wavelength of from 800 to 1000 nm. The near-infrared absorbing colorant is preferably selected from the group consisting of polymethine dyes, squarilium dyes, dithiol metal complexes, dithiolene complexes, aminium dyes, imonium dyes, and phthalocyanines. Alternatively, the timing marks may include a white pigment having an absorption at a wavelength of from 880 to 920 nm. The white pigment is preferably selected from the group consisting of electroconductive zinc oxide, electroconductive titanium oxide, electroconductive tin oxide, and electroconductive indium oxide.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

According to the label issuing method of the present invention, label sheets with a thermosensitive adhesive layer which can be heat-activated can be stably produced continuously. The resultant label sheets can be well attached to a good without causing the peeling problem mentioned above.

At first, the label issuing method of the present invention will be explained in detail referring to drawings.

Figure 3A:
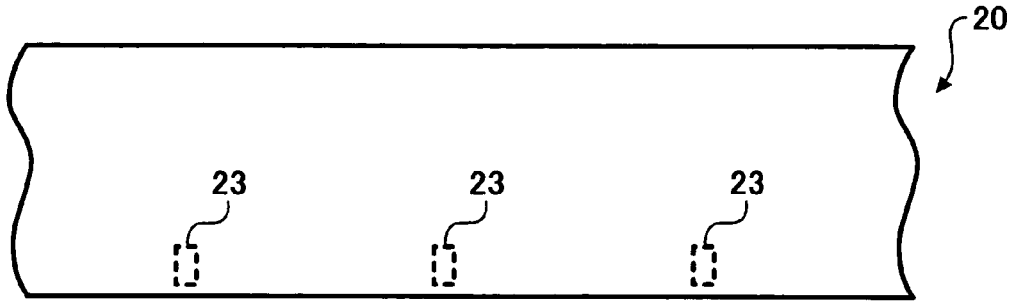
FIGS. 3A to 3D are schematic diagrams illustrating a second type of label sheet for use in the present invention, which has an adhesive layer on the backside thereof.
Figure 3B:
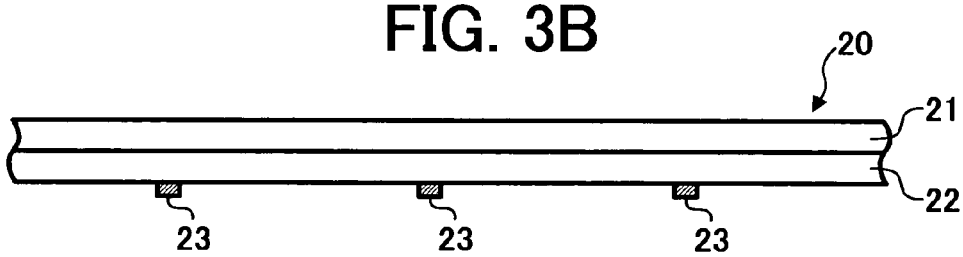
Figure 3C:
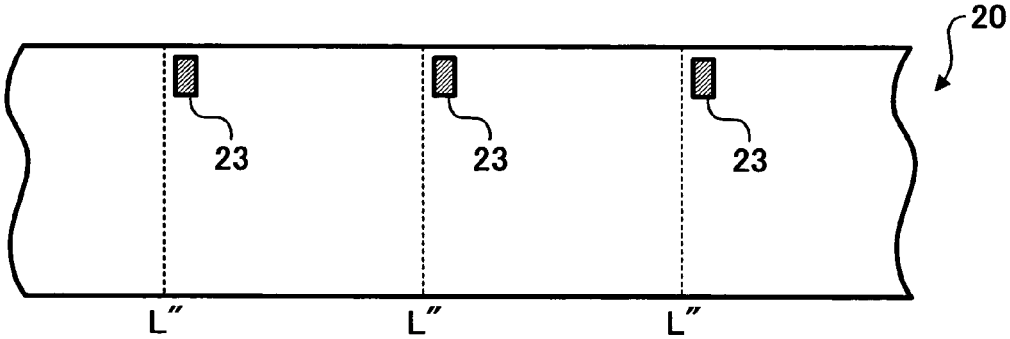
Figure 3D:
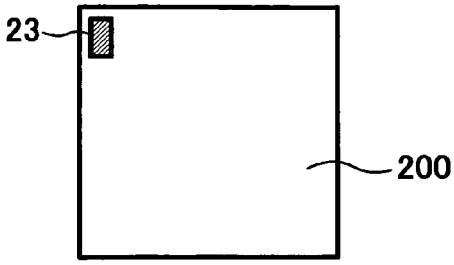

As illustrated in FIGS. 3A to 3C, a long label sheet 20 (hereinafter sometime referred to as a first label sheet) for use in the label issuing method of the present invention includes a support 21 such as plain papers, coated papers, thermosensitive recording materials, thermal transfer receiving materials, inkjet recording materials and pressure sensitive recording materials, a thermosensitive adhesive layer 22 and timing marks 23. The timing marks 23, which are apart from the side edges of the first label sheet 20, are arranged at regular intervals. When the first label sheet 20 is cut at a line L", a second label sheet 200, which is illustrated in FIG. 3D, is produced.

Figure 4:
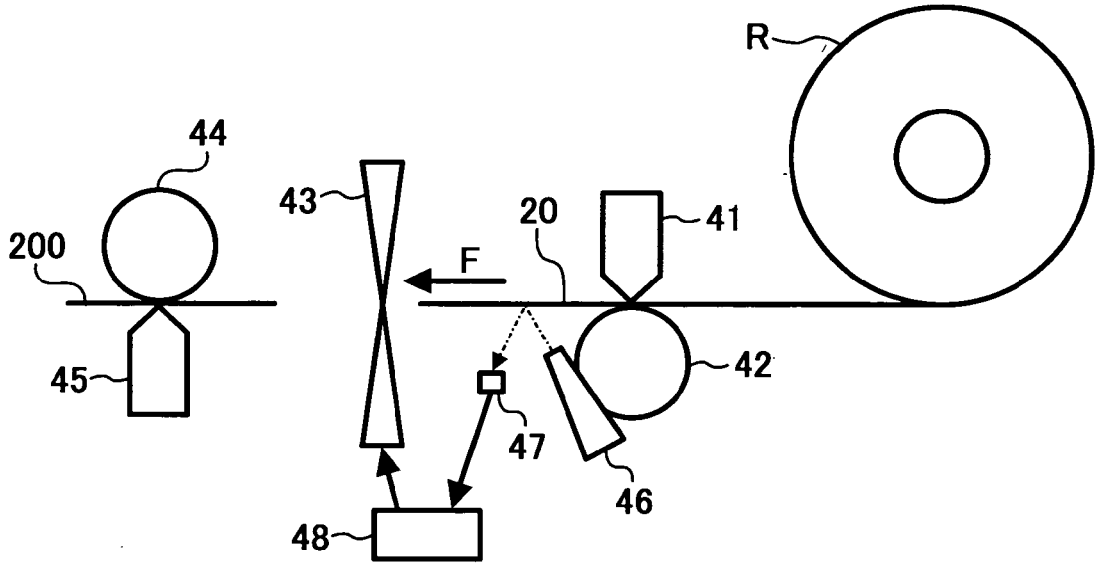
FIG. 4 is a schematic view illustrating a printer for use in the label issuing method of the present invention.

FIG. 4 is a schematic view illustrating a printer for use in the label issuing method of the present invention. Referring to FIG. 4, numerals R, 41, 42, and 43 denote a roll of the first label sheet 20; a thermal printing device such as thermal printheads which record information on the surface of the first label sheet 20; a platen roller; and a cutter configured to cut the first label sheet 20 to produce a second label sheet 200. In addition, numerals 46, 47 and 48 denote a light source configured to irradiate the backside of the first label sheet 20 with light; a timing mark detector; and a controller. Further, numerals 44 and 45 denote a second platen roller; and a heater configured to heat the adhesive layer of the second label sheet 200 to activate the adhesive layer.

As illustrated in FIGS. 3B and 3C, the thermosensitive adhesive layer 22 are formed on the backside of the first label sheet 20 and the timing marks are formed on the adhesive layer 22 at regular intervals. In this case, a thermosensitive recording layer is formed on the front side of the support 21.

Then the method for issuing the second label 200 will be explained referring to FIG. 4. The first label sheet 20 is fed in a direction F at substantially a constant speed. Information is recorded on the thermosensitive recording layer by the thermal recording device 41 and the first label sheet 20 is cut by the cutter 43 to produce the second label sheet 200 on which the information is recorded.

The first label sheet 20 is cut at a predetermined position (for example, the line L" illustrated in FIG. 3C). The cutting position can be changed depending on, for example, the position of the timing mark detector 47 and the interval between the detection of the timing mark and the output of a cutting signal made by the controller 48 which converts the timing mark detection signal to the cutting signal.

Then the timing mark detection operation and the cutting operation will be explained. As illustrated in FIG. 4, the light emitted by the light source 46 irradiates the backside of the first label sheet 20 with light, on the surface of which information is recorded by the thermal recording device 41, and the light reflected by the backside is received by the detector (i.e., a sensor which is a photocell) 47. When the light irradiates the timing mark, the quantity of the light reflecting from the timing mark is smaller than that of the light reflecting from a non-mark area. Thus, the detector 47 detects the timing mark. The detection signal (i.e., an electric signal) is sent to the controller 48 (such as a computer). The controller 48 converts the electric signal to a cutting signal by which the cutter 43 is operated to cut the first label sheet. The cutting signal is output when a predetermined time passes after the reception of the detection signal. In this regard, the cutting signal is output while considering the moving speed of the first label sheet 20, and the position of the cutter relative to the position of the detector 47.

The backside (i.e., the thermosensitive adhesive layer) of the thus cut label sheet 200 is heated by the heater 45 such that the thermosensitive adhesive layer is thermally activated. Thus, the adhesive layer develops an adhesive property. The second label sheet 200 is attached to a good.

Suitable devices for use as the thermal recording device 41 include thermal printheads. In addition, suitable devices for use as the heater 45 include thermal printheads, heat rollers, infrared irradiating devices, hot air blowing devices, etc. Among these devices, thermal printheads are preferable because thermal printheads are safe and consume low energy and therefore the printer can be miniaturized.

As the cutter 43, various cutters can be used. Specific examples of the cutter include rotary cutters and guillotine cutters. As for the cutting method, various cutting methods such as entire cutting, perforation cutting and partial cutting are available.

Figure 5:
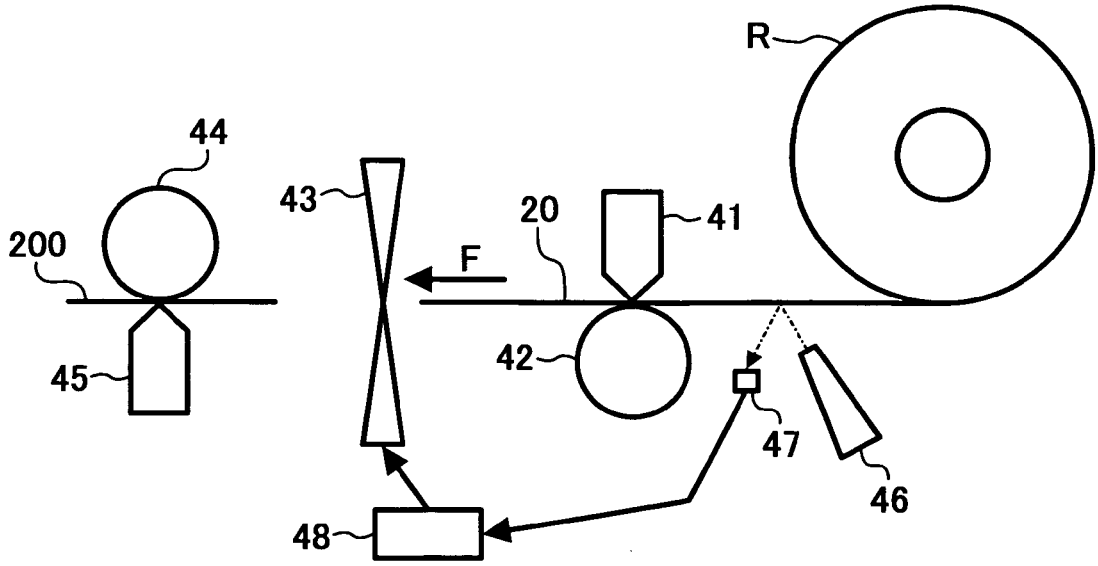
FIG. 5 is a schematic view illustrating another printer for use in the label issuing method of the present invention.

FIG. 5 is a schematic view of another embodiment of the printer for use in the label issuing method of the present invention. The printer is the same as the printer illustrated in FIG. 4 except that the light source 46 and the detector 47 are located before the thermal recording device 41 relative to the feeding direction F of the first label sheet 20. In this printer, thermal printing on the thermosensitive recording layer can be started according to a timing mark detection signal output by the detector 47.

Then the first label sheet with a thermosensitive adhesive layer will be explained in detail.

The first label sheet for use in the label issuing method of the present invention includes a support and a thermosensitive adhesive layer. In addition, timing marks are formed on the thermosensitive adhesive layer. The width of the first label sheet is generally from 10 mm to 200 mm, and typically from 40 mm to 150 mm. The length of the first label sheet is not particularly limited, but is generally from 30 m to 200 m and typically from 50 m to 150 m. The first label sheet is typically roll-shaped.

The first label sheet is typically prepared by forming a thermosensitive adhesive layer on a support, followed by printing of timing marks on the thermosensitive adhesive layer.

The thermosensitive adhesive layer includes a thermoplastic resin which develops an adhesive property when heated, and a solid plasticizer. Suitable materials for use as the thermoplastic resins include known thermoplastic resins such as acrylic resins, alkyd resins obtained by phthalic anhydride, isophthalic acid, terephthalic acid or the like, polyester resins, epoxy resins, phenolic resins, urethane resins, melamine resins, etc. Among these resins, acrylic resins are preferably used because of exhibiting good adhesion force when heated and hardly causing a dust-adhered head problem in that a part of the adhesive layer adheres to the thermal printhead used for heat-activating the adhesive layer, and thereby the part of the thermal printhead on which the dust adheres cannot apply a sufficient amount of heat to the adhesive layer, resulting in formation of non-activated area in the adhesive layer.

Acrylic resins are vinyl polymers which are obtained from one or more monomers including acrylic acid, methacrylic acid an acrylic acid ester and/or a methacrylic acid ester as a main component and which are solid at room temperature but exhibit an adhesive property when heated. Specific examples of the acrylic resins include poly(meth)acrylates, acrylic acid/acrylate copolymers, 2-ethylhexyl acrylate/methyl acrylate/acrylic acid copolymers, styrene/(meth)acrylate copolymers, vinyl acetate/(meth)acrylate copolymers, ethylene/(meth)acrylate copolymers, etc.

In the present invention, silicone-modified thermoplastic resins can be preferably used for the adhesive layer of the first label sheet. Silicone-modified thermoplastic resins mean thermoplastic resins having a silicone group (i.e., an organopolysiloxane group) which is connected to at least one part of the molecule of the thermoplastic resins.

Specific examples of the silicone modified thermoplastic resins which can exhibit an adhesive property when heated include silicone-modified versions of the resins mentioned above. Among these silicone-modified resins, silicone-modified acrylic resins are preferably used.

As the silicone group which is connected to the modified resins, linear organopolysiloxane groups and ring organopolysiloxane groups can be used.

The silicone-modified resins can be prepared, for example, by one of the following methods:

(1) a method in which a macrovinyl monomer having a long silicone chain is copolymerized with another vinyl monomer;

(2) a method in which a silicone vinyl monomer is graft-copolymerized with a thermoplastic resin; and (3) a method in which a reactive organopolysiloxane is reacted with a thermoplastic resin.

Among these silicone-modified resins, silicone-grafted acrylic resins which are prepared by copolymerizing a silicone macrovinylmonomer with an acrylic vinyl monomer can be preferably used.

Such silicone-modified acrylic resins are commercially available. The silicone-modified acrylic resins are typically in the form of aqueous emulsion or organic solvent solution.

Specific examples of the marketed silicone-grafted acrylic resins are shown in Table 1.

TABLE 1

| Tradename | Form | Glass transition temp. *1) (Tg) (° C.) | Peel strength (g/2.54 cm) *2) | Water-repellent property (contact angle) (degree) | Maker |
|---|---|---|---|---|---|
| SIMAX ® US-450 | Aqueous solution | About 70 | 150 | 102 | Toagosei Co., Ltd. |
| SIMAX ® US-480 | Solution | — | — | — | " |
| SIMAX ® US-218E | Aqueous emulsion | About −5 | — | 90 | " |
| SIMAX ® US-220E | Aqueous emulsion | About 20 | — | 92 | " |
| SIMAX ® US-224E | Aqueous emulsion | About 10 | — | 95 | " |
| SIMAX ® US-230 | Aqueous emulsion | About 40 | — | 95 | " |
| AQUABRID ® 903 | Aqueous emulsion | 10 | — | — | Dicel chemical Industries Ltd. |
| ASI ® 91 | Aqueous emulsion | 25 | — | — | Dicel chemical Industries Ltd. |
| ASI ® 784 | Aqueous emulsion | 15 | — | — | Dicel chemical |

TABLE 1-continued

| Tradename | Form | Glass transition temp. *1) (Tg) (° C.) | Peel strength (g/2.54 cm) *2) | Water-repellent property (contact angle) (degree) | Maker |
|---|---|---|---|---|---|
| | | | | | Industries Ltd. |
| CS-179 | Aqueous emulsion | 45 | — | — | Dicel chemical Industries Ltd. |
| X-22-8084EM | Aqueous emulsion | — | — | — | Shin-Etsu Chemical Co., Ltd. |
| X-22-8053 | Solution of iso-propanol | — | — | — | Shin-Etsu Chemical Co., Ltd. |
| KANEBINOL ® KD20 | Aqueous emulsion | 45 | — | — | Kanega-fuchi Chemical Ind. Co., Ltd. |
| KANEBINOL ® KD4 | Aqueous emulsion | 100 | — | — | Kanega-fuchi Chemical Ind. Co., Ltd. |

*1): The glass transition temperature is that of the acrylic polymer constituting the main portion of the silicone-grafted acrylic resin.
*2): The peel strength is measured by the following method: (1) a cellophane tape is adhered to a coating film at 60° C. for 20 hours at a pressure of 40 g/cm$^2$; and (2) the cellophane tape is peeled from the coating film at an angle of 180° to measure the peel strength.

The silicone-modified thermoplastic resins for use in the adhesive layer preferably have a friction coefficient of from 0.40 to 1.02. By using a silicone-modified thermoplastic resin having such a friction coefficient, the resultant adhesive layer can exhibit good adhesion property and hardly causes the dust-adhered head problem. The friction coefficient can be determined by a method specified in JIS P8147.

Resin complexes of a silicone-modified thermoplastic resin and a thermoplastic resin which is not modified with a silicone can also be preferably used for the adhesive layer. In this regard, the resin complex means a resin in which both the resins are united while they are closely contacted with each other. Specific examples of the resin complexes include blended resins in which a silicone-modified resin and a non-modified resin are blended while melted; resin particles having a core-shell structure, in which a core of a non-modified resin is covered with a shell of a silicone-modified resin, etc.

Specific examples of the non-modified resins for use in the resin complexes include (meth) acrylic acid ester copolymers, styrene/isoprene copolymers, styrene/acrylate copolymers, styrene/butadiene copolymers, acrylonitrile/butadiene copolymers, ethylene/vinyl acetate copolymers, vinyl acetate/acrylate copolymers, ethylene/vinyl chloride copolymers, ethylene/acrylate copolymers, vinyl acetate/ethylene/vinyl chloride copolymers, vinyl acetate/ethylene/acrylate copolymers, vinyl acetate/ethylene/styrene copolymers, acrylic acid/2-ethylehexyl acrylate copolymers, copolymers obtained from butyl acrylate, natural rubber, graft copolymers of natural rubber with an acrylic resin, polybutadiene, polyurethane, etc. These resins can be used alone or in combination.

Suitable resins for use as the core material in the shell-core resin particles mentioned above include acrylic resins which are not modified with a silicone. Suitable resins for use as the shell material in the shell-core resin particles include silicone-modified acrylic resins. Specific examples of the acrylic resins for use as the silicone-modified acrylic resins include (meth)acrylic acid ester resins, styrene/(meth) acrylate copolymers, vinyl acetate/(meth)acrylate copolymers, ethylene/(meth)acrylate copolymers, vinyl acetate/ethylene/(meth)acrylate copolymers, etc.

When the adhesive layer includes a silicone-modified thermoplastic resin, the adhesive layer has advantages such that the resultant adhesive layer has good adhesive property when thermally activated and hardly causes the dust-adhered head problem.

In general, silicone oils and pure silicone resins are typically used for electrically-insulative varnishes, water-repellent agents, release agents, etc. By using such silicone oils and silicone resins for the adhesive layer, the dust-adhered head problem can be avoided. However, such silicone oils and silicone resins have too poor adhesion force to be used for the adhesive layer. However, when silicone-modified resins are used for the adhesive layer, the resultant adhesive layer has not only good releasability from thermal printheads but also good adhesive property against various goods to which the labels are to be attached. In addition, a roll of the long label sheet having such an adhesive layer hardly causes a blocking problem in that the adhesive layer adheres to the support (i.e., the face material), resulting in formation of a block of the long label sheet roll, and thereby the roll cannot be used as a label sheet. This is because the silicone-modified resin in the adhesive layer has good releasability.

As mentioned above, silicone-modified acrylic resins are preferably used for the adhesive layer in view of adhesive property and ability to prevent the dust-adhered head problem (i.e., releasability).

It is preferable for the core-shell type resin particles that an unmodified acrylic resin is used as the core material and a silicone-modified acrylic resin is used as the shell material. The adhesive layer including such core-shell resin particles has good adhesive property and hardly causes the dust-adhered head problem. This is because both the releasability of the silicone modified and adhesiveness of the unmodified acrylic resin can be effectively imparted to the adhesive layer.

The thermosensitive adhesive layer of the first label sheet for use in the label issuing method of the present invention includes a solid plasticizer. Suitable solid plasticizers for use in the adhesive layer include known solid plasticizers.

Specific examples thereof include benzyl parahydroxybenzoate, propyl parahydroxybenzoate, ethyl parahydroxybenzoate, dihexyl phthalate, dicyclohexyl phthalate, dihydroxyabietyl phthalate, diphenyl phthalate, N-cyclohexyl-p-toluenesulfoneamide, sucrose benzoate, trimethylolethane tribenzoate, pentaerythritol tetrabenzoate, sucrose octaacetate, dimethyl isophthalate, tricyclohexyl citrate, ethylene glycol dibenzoate, catechol derivatives such as catechol dipalmitate, catechol distearate and catechol dibenzoate, hindered phenol compounds such as thiobis[ethylene-3-(3,5-di-t-butyl-4-hydroxyphenyl)propionate], triethyleneglycolbis[3-(3-t-butyl-4-hydroxy-5-methylphenyl)propionate] and 1,6-hexanediolbis[3,5-di-t-butyl-4-hydroxyphenyl]propionate], triazole compounds such as 2-[5'-(1",1",3",3"-tetrabutyl)-2'-hydroxyphenyl]benzotriazole, 2-[5'-(1",1",2",3"-tetramethylbutyl)-2'-hydroxyphenyl]benzotriazole and 2-(3'-t-butyl-5'-methyl-2'-hydroxyphenyl)-5-chlorotriazole, thiazole compounds such as dibenzothiazylsulfide and cyclohexylamine salt of 2-mercaptobenzothiazole, sulfeneamide compounds such as N-cyclohexyl-2-benzothiazolylsulfeneamide and N,N-dicyclohexyl-2-2-benzothiazolylsulfeneamide, dithiocarbamate compounds such as pipecolyl dithiocarbaate and zinc salt of dibutyldithiocarbamate, atomatic secondary amine compounds such as 4,4'-bis(α,α-dimethylbenzyl)diphenylamine, p-(p-toluenesulfonylamide)diphenylamine and N,N'-diphenyl-p-phenylenediamine-N-phenyl-N'-(3-methacryloxy-2-hydroxypropyl)-p-phenylenediamine, etc. These compounds can be used alone or in combination.

The solid plasticizers for use in the thermosensitive adhesive layer preferably have a melting point of from 40 to 200° C., and more preferably from 60 to 160° C.

When a combination of a thermoplastic resin and a solid plasticizer is heated, the solid plasticizer melts at a temperature not lower than its melting point and plasticizes the thermoplastic resin, and thereby the combination can exhibit adhesiveness. The duration of the adhesiveness depends on the species of the solid plasticizer used. Benzyl parahydroxybenzoate, and propyl parahydroxybenzoate can be preferably used for the thermosensitive adhesive layer because of maintaining adhesiveness for a long time and having good adhesiveness in a wide range of environmental temperatures.

In the thermosensitive adhesive layer, the weight ratio of the solid plasticizer to the thermoplastic resin is from 50/100 to 500/100, and preferably from 100/100 to 400/100. When the weight ratio is too small, the blocking problem tends to occur. In contrast, when the weight ratio is too large, the adhesiveness deteriorates and in addition, a chalking problem in that the solid plasticizer which exudes from the adhesive layer is present like a powder on the adhesive layer tends to occur.

The adhesive layer can include a supercooling ability improver to improve the supercooling ability of the solid plasticizer particularly at low environmental temperatures.

Specific examples of the supercooling ability improver include naphthol derivatives such as 2-benzyloxynaphthalene, biphenyl derivatives such as metaterphenyl, acetyl biphenyl, p-benzyl biphenyl and 4-allyloxy biphenyl, polyether compounds such as 1,2-bis(3-methylphenoxy)ethane, 2,2'-bis(4-methoxyphenoxy)diethylehter, and bis(4-methoxyphenyl)ether, diphenyl carbonate, dibenzyl oxalate, di(p-chlorobenzyl)oxalate, di(p-methylbenzyl)oxalate, etc.

Among these supercooling ability improvers, diesters of oxalic acid are preferable. In particular, dibenzyl oxalate, biphenyl oxalate, and their derivatives are preferable because of having an ability of maintaining the liquid state of the solid plasticizer used and preventing the blocking problem.

The weight ratio of the supercooling ability improver to the solid plasticizer in the adhesive layer is from 10/100 to 50/100 and preferably from 20/100 to 35/100. When the weight ratio is too small, the resultant adhesive layer cannot exhibit good adhesiveness at a low temperature. In contrast, when the weight ratio is too large, the resultant adhesive layer cannot exhibit good adhesiveness at a high temperature.

When the thermosensitive adhesive layer is prepared, the solid plasticizers and supercooling ability improvers are typically used in the form of aqueous dispersions which are prepared by pulverizing the materials using a wet-type or dry-type pulverizer such as ball mills, sand mills, paint shakers, DYNO MILL, attritor and HENSCHEL MIXER. In addition, the materials can be used while being microencapsulated. The particle diameter of the particles in the aqueous dispersions and the microcapsules is preferably not greater than 10 μm, more preferably not greater than 5 μm, and even more preferably from 1 to 2 μm.

The thermosensitive adhesive layer can include a tackifier to improve the adhesiveness thereof. Specific examples thereof include known tackifiers such as terpene resins, aliphatic petroleum resins, aromatic petroleum resins, coumarone-indene resins, styrene resins, phenolic resins, terpene-phenol resins, rosin, rosin derivatives, etc. The weight ratio of the tackifier to the thermoplastic resin in the adhesive layer is not greater than 200/100, and preferably from 20/100 to 150/100. When the weight ratio is too large, the resultant label sheet tends to cause the blocking problem.

The thermosensitive adhesive layer can include additives such as pigments. Specific examples of the pigments include inorganic pigments such as carbonates, oxides, hydroxides, sulfates of metals such as aluminum, calcium, magnesium, barium and titanium; silica, zeolite, kaolin, and calcined kaolin; and organic pigments such as starch, natural waxes and synthesized waxes.

The thermosensitive adhesive layer can include a binder resin to improve the adhesion of the adhesive layer to the support (i.e., the face material) and to increase the cohesive force in the adhesive layer. Specific examples of the binder resins include polyvinyl alcohol, polyvinyl acetate, oxidized starch, etherified starch, cellulose derivatives such as carboxymethyl cellulose and hydroxyethyl cellulose, casein, gelatin, sodium alginate, etc. These binder resins are typically used in the form of aqueous solution, aqueous dispersion or aqueous emulsion.

The binder resin is included in the adhesive layer in an amount such that the original adhesion force of the adhesive layer is not decreased. The amount thereof is typically not greater than 30% by weight, and preferably not less than 10% by weight based on the total weight of the solid components of the adhesive layer.

The thermosensitive adhesive layer can include additives such as hardeners, antiseptics, dyes, ultraviolet absorbents, antioxidants, pH controllers, antifoaming agents, etc.

The thermosensitive adhesive layer can be typically formed by coating or printing a coating liquid on a support using any one of coating or printing methods for use in the conventional paper coating and printing. Specific examples of the coating methods and printing methods include blade coating, gravure coating, gravure offset coating, bar coating, roll coating, knife coating, air knife coating, comma coating, U-comma coating, smoothing coating, microgravure coating, reverse roll coating, roll coating, dip coating, curtain coating, slide coating, die coating, flexographic printing, relief printing, gravure printing, offset printing, etc.

When a thermosensitive adhesive layer coating liquid is applied on a support, followed by drying, the coating liquid is dried at a temperature lower than the melting point of the solid plasticizer included in the adhesive layer coating liquid. Drying is preferably performed by a heating method using hot air, infrared, microwave or radio frequency wave as a heat source.

The coating weight of the thermosensitive adhesive layer is typically from 2 to 50 g/m$^2$, and preferably from 5 to 35 g/m$^2$ on a dry basis. When the coating weight is too small, the resultant adhesive layer has poor adhesion force when heat-activated. In contrast, when the coating weight is too large, the manufacturing cost of the adhesive layer increases.

In the first label sheet for use in the method of the present invention, the thermosensitive adhesive layer has a friction coefficient of from 0.40 to 1.20 and preferably from 0.50 to 0.90. The friction coefficient of the adhesive layer is measured by the method specified in JIS P8147. In this measurement, the adhesive layer of one sheet of a label is contacted with the adhesive layer of another sheet of the label.

The first label sheets for use in the label issuing method of the present invention can include an undercoat layer, which includes air (e.g., air bubbles, an air layer or the like) therein, between the thermosensitive adhesive layer and the support (i.e., the face material). By forming such an undercoat layer, the heat energy applied to the adhesive layer can be efficiently applied thereto particularly when a thermal printhead is used for heating the adhesive layer. Namely, by forming such an undercoat layer, the adhesive layer can be efficiently activated with a small amount of energy. When the first label sheet has a thermosensitive recording layer on the support and the adhesive layer is heated with a large amount of energy, the heat energy applied to the adhesive layer is transferred (scattered) to the thermosensitive recording layer, and thereby a problem in that the background of the thermosensitive recording layer is colored occurs.

By forming the undercoat layer between the adhesive layer and the support, such a coloring problem can be avoided because the undercoat layer prevents the heat applied to the adhesive layer from being diffused to the thermosensitive recording layer. In addition, silicone resins, silicone-modified thermoplastic resins and silicone-containing core-shell type resin particles for use in the adhesive layer typically have a high heat resistivity, i.e., the adhesive layer has poor thermosensitivity. By forming the above-mentioned undercoat layer, the thermosensitivity of the adhesive layer can be improved.

With respect to the undercoat layer, the more the air content in the undercoat layer, the better heat insulating property the undercoat layer has. In order to include air in the undercoat layer, various known methods can be used therefor. However, a method in which hollow particles are included in the undercoat layer is typically used.

Hollow particles having a shell including a thermoplastic resin are typically used for the undercoat layer. Specific examples of the shell material include polymers such as acrylic resins, vinylidene chloride resins, etc. The polymers for use as the shell of the hollow particles preferably have a glass transition temperature of from 20 to 200° C., and more preferably from 40 to 150° C. The hollow particles preferably has an average particle diameter of from 0.2 to 20 μm, more preferably from 0.7 to 10 μm, and even more preferably from 1.5 to 6 μm. The hollow rate (i.e., volume of air/volume of hollow particle) is preferably from 30 to 98% by volume, and more preferably from 45 to 95% by volume.

Suitable materials for use as the support of the label sheet include any known support materials such as papers and plastic sheets.

The plain papers for use as the support typically include wood pulp and a filler. Specific examples of the wood pulp include chemical pulp such as LBKP and NBKP, mechanical pulp such as GP, PGW, RMP, TMP, CTMP, CMP and CGP, and waste paper pulp such as DIP. The papers for use as the support are prepared by mixing a pulp with one or more known additives, such as pigments, binders, sizing agents, fixers, yield improving agents, cationization agents and paper strength increasing agents, if necessary, and producing a paper using an apparatus such as a fourdrinier, cylinder machine and twin-wire paper machine under an acidic, neutral or alkaline condition. Furthermore, the base paper may be treated with an on-machine calender having a metal roller and a synthetic resin roller. Alternatively, the papers may be subjected to an off-machine treatment, followed by a calender treatment using a supercalender machine to control the flatness of the papers.

Specific examples of the fillers included in the papers for use in the support include white inorganic pigments such as precipitated calcium carbonate light, ground calcium carbonate, kaolin, talc, calcium sulfate, barium sulfate, titanium dioxide, zinc oxide, satin white, aluminum silicate, diatom earth, calcium silicate, magnesium silicate, synthesized silica, aluminum hydroxide, alumina, lithopone, zeolite, magnesium carbonate and magnesium hydroxide; and organic pigments such as styrene resin pigments, acrylic resin pigments, polyethylene resin pigments, microcapsule pigments, urea resin pigments and melamine resin pigments.

The papers can include a sizing agent such as rosin sizing agents (for acidic paper manufacturing conditions or neutral paper manufacturing conditions), AKD (i.e., alkyl ketene dimer), ASA (i.e., alkenyl succinic anhydride) and cationic polymer sizing agents.

As the paper for use as the support, glassine papers, art papers, coated papers, cast papers, etc. can also be used. Specific examples of the coated papers include inkjet recording papers, thermosensitive papers, pressure sensitive papers, sublimation type thermal transfer recording papers, thermofusible ink type thermal transfer recording papers, metal-deposited papers, etc. In addition, synthetic papers, laminated papers in which one of both sides of a paper is laminated with a plastic sheet, a metal sheet, etc., mica papers, glass papers, etc. can also be used as the support.

Specific examples of the plastic sheets for use as the support include sheets of a plastic such as polyethylene, polypropylene, polyethylene terephthalate, and polyaminde. In addition, non-woven clothes made of a plastic such as the polymer mentioned above can also be used as the support. Further, these plastic sheets and non-woven clothes can be subjected to a treatment such as coating and hologram treatments.

A print layer can be previously formed on the side of the support opposite that bearing the adhesive layer. The print layer can be formed by a printing method such as printing using ultraviolet rays or electron beams, flexographic printing methods, etc.

When a thermosensitive recording layer is formed on the support (e.g., a thermosensitive recording material is used as the support), known materials for use in conventional thermosensitive recording materials, such as combinations of coloring materials (e.g., leuco dyes) with color developers can be used.

Specific examples of the leuco dyes include fluoran compounds, triaryl methane compounds, spiropyran compounds, diphenylmethane compounds, thiazine compounds, lactam compounds, fluorene compounds, etc. It is preferable that the leuco dyes have an absorption spectrum such that at least one maximum absorption is observed at a wavelength of from 550 to 1000 nm.

Specific examples of fluoran-type leuco compounds include the following:

3-diethylamino-6-methyl-7-anilinofluoran,
3-dibutylamino-6-methyl-7-anilinofluoran,
3-(N-methyl-N-cyclohexylamino)-6-methyl-7-anilinofluoran,
3-(N-ethyl-N-isopentylamino)-6-methyl-7-anilinofluoran,
3-(N-isobutyl-N-ethylamino)-6-methyl-7-anilinofluoran,
3-[N-ethyl-N-(3-ethoxypropyl)amino]-6-methyl-7-anilinofluoran,
3-(N-ethyl-N-hexylamino)-6-methyl-7-anilinofluoran,
3-dipentylamino-6-methyl-7-anilinofluoran,
3-(N-methyl-N-propylamino)-6-methyl-7-anilinofluoran,
3-(N-ethyl-N-tetrahydrofurylamino)-6-methyl-7-anilinofluoran,
3-diethylamino-6-methyl-7-(p-chloroanilino)fluoran,
3-diethylamino-6-methyl-7-(p-fluoroanilino)fluoran,
3-(p-toluidinoethylamino)-6-methyl-7-anilinofluoran,
3-diethylamino-6-methyl-7-(p-toluidino)fluoran,
3-diethylamino-6-methyl-7-(3,4-dichloroanilino)fluoran,
3-pyrrolidino-6-methyl-7-anilinofluoran,
3-diethylamino-6-chloro-7-ethoxyethylaminofluoran,
3-diethylamino-6-chloro-7-anilinofluoran,
3-diethylamino-7-phenylfluoran, and
3-(p-toluidinoethylamino)-6-chloro-7-phenethylfluoran.

Specific examples of triarylmethane-type leuco compounds include the following:

3,3-bis(p-dimethylaminophenyl)-6-dimethylaminophthalide (i.e., crystal violet lactone (CVL)),
3,3-bis(p-dimethylaminophenyl)phthalide,
3-(p-dimethylaminophenyl)-3-(1,2-dimethylaminoindole-3-yl)phthalide,
3-(p-dimethylaminophenyl)-3-(2-methylindole-3-yl)phthalide,
3-(p-dimethylaminophenyl)-3-(2-phenylindole-3-yl)phthalide,
3,3-bis(1,2-dimethylindole-3-yl)-5-dimethylaminophthalide,
3,3-bis(1,2-dimethylindole-3-yl)-6-dimethylaminophthalide,
3,3-bis(9-ethylcarbazole-3-yl)-5-dimethylaminophthalide,
3,3-(2-phenylindole-3-yl)-5-dimethylaminophthalide, and
3-p-dimethylaminophenyl-3-(1-methylpyrrol-2-yl)-6-dimethylaminophthalide.

Specific examples of spiropyran-type leuco compounds include the following:

3-methylspirodinaphtopyran,
3-ethylspirodinaphtopyran,
3,3'-dichlorospirodinaphtopyran,
3-benzylspirodinaphtopyran,
3-propylspirobenzopyran,
3-methylnaphto-(3-methoxybenzo)spiropyran, and
1,3,3-trimethyl-6-nitro-8'-methoxyspiro(indoline-2,2'benzopyran).

Specific examples of diphenylmethane-type leuco compounds include the following:

N-halophenyl-leucoauramine,
4,4'-bis-dimethylaminophenylbenzhydrylbenzyl ether, and
N-2,4,5-trichlorophenyl-leucoauramine.

Specific examples of thiazine-type leuco compounds include the following:

benzoyl leuco methylene blue and
p-nitrobenzoyl leuco methylene blue.

Specific examples of lactam-type leuco compounds include the following:

rhodamine B-anilinolactam and
rhodamine B-p-chloronilinolactam.

Specific examples of the fluorene-type leuco compounds include the following:

3,6-bis(dimethylamino)fluorenespiro-(9,3')-6'-dimethylaminophthalide,
3,6-bis(dimethylamino)fluorenespiro-(9,3')-6'-pyrrolidinophthalide, and
3-dimethylamino-6-diethylaminofluorenespiro-(9,3')-6'-pyrrolidinophthalide.

Specific examples of basic leuco dyes include the following:

3-diethylamino-6-methyl-7-chlorofluoran,
3-cyclohexylamino-6-chlorofluoran,
3-diethylamino-benzo[α] fluoran,
3-dibuthylamino-benzo[α] fluoran,
3-diethylamino-7-chlorofluoran,
3-diethylamino-7-methylfluoran,
3-N-ethyl-N-isoamylamino-benzo[α] fluoran,
3-N-ethyl-N-p-methylphenylamino-7-methylfluoran,
3-diethylamino-6,8-dimethylfluoran,
3-dibuhylamino-6-methyl-7-bromofluoran,
3,6-bis(diethylaminofluorane)-γ-(4'-nitro)anilinolactam,
bis(1-n-buthyl-2-methylindole-3-yl)phthalide,
bis(1-ethyl-2-methylindole-3-yl)phthalide,
3-(4-diethylaminophenyl)-3-(1-ethyl-2-methylindole-3-yl) phthalide,
3-(4-diethylamino-2-ethoxyphenyl)-3-(1-ethyl-2-methylindole-3-yl)-4-azaphthalide,
3-(4-diethylaminophenyl)-3-(1-methyl-2-methylindole-3-yl)phthalide,
3-(4-diethylamino-2-methylphenyl)-3-(1-ethyl-2-methylindole-3-yl)phthalide,
3,3-bis(4-diethylaminophenyl)-6-diethylaminophthalide,
3,7-bis(4-dimethylamino)-10-benzorylphenothiazine,
3,3-bis(4-diethylamino-6-ethoxyphenyl)-4-azaphthalide,
3-diethylamino-7-dianilinofluoran,
3-N-ethyl-N-4-methylphenylamino-7-N-methylanilinofluoran,
3-diethylamino-7-N-dibenzylaminofluoran,
3,6-dimethoxyfluoran,
3,6-dibutoxyfluoran, 3'-methoxy-4'-lanoxyphenyl-2-citrylquinoline, and
2',4'-dioctoxyphenyl-2-citrylquinoline.

Suitable color developers for use in the thermosensitive recording layer include known color developers, which are conventionally used for pressure-sensitive recording papers or thermosensitive recording papers, but are not limited thereto.

Specific examples of the color developer are as follows:

phenolic compounds such as bis(3-allyl-4-hydroxyphenyl) sulfone,
α-naphthol,
β-naphthol,
p-octylphenol,
4-t-octylphenol,
p-t-butylphenol,
p-phenylphenol,
1,1-bis(p-hydroxyphenyl)propane,
2,2-bis(p-hydroxyphenyl)propane (i.e., bisphenol A (BPA)),
2,2-bis(p-hydroxyphenyl)butane,
1,1-bis(p-hydroxyphenyl)cyclohexane,
4,4'-thiobisphenol,
4,4'-cyclohexylidendiphenol,
2,2'-(2,5-dibromo-4-hydroxyphenyl)propane,
4,4-isopropylidenbis(2-t-butylphenol),
2,2'-methylenebis(4-chlorophenol),
4,4'-dihydroxydiphenylsulfone,
4-hydroxy-4'-methoxydiphenylsulfone,
4-hydroxy-4'-ethoxydiphenylsulfone,
4-hydroxy-4'-butoxydiphenylsulfone,
methyl bis(4-hydroxyphenyl)acetate,
butyl bis(4-hydroxyphenyl)acetate,
benzyl bis(4-hydroxyphenyl)acetate, and
2,4-dihydroxy-2'-methoxybenzanilide; and aromatic carboxylate derivatives, aromatic carboxylic acids and their metal salts such as benzyl p-hydroxybenzoate,
ethyl p-hydroxybenzoate,
dibenzyl 4-hydroxyphthalate,
dimethyl 4-hydroxyphthalate,
ethyl 5-hydroxyisophthalate,
3,5-di-t-butylsalicylic acid, and
3,5-di-α-methylbenzylsalicylic acid.

Specific examples of the binders for use in the thermosensitive recording layer are as follows:

natural water-soluble polymers such as starches;

cellulose derivatives such as hydroxyethyl cellulose, methyl cellulose, ethyl cellulose and carboxymethyl cellulose;

proteins such as casein and gelatin;

oxidized starches, esterified starches and sucrose derivatives;

water-soluble resins such as polyvinyl alcohol, modified polyvinyl alcohol, polyvinyl pyrrolidone, polyacrylic acid, sodium polyacrelate, acrylamide/acrylic ester copolymers, acrylamide-acrylic ester/methacrylic acid copolymers, alkali salts of styrene/maleic anhydride copolymers, alkali salts of ethylene-maleic anhydride copolymers, polyacrylamides and styrene/maleic anhydride copolymers;

latexes of resins such as polyvinyl acetate, polyurethane, polyacrylate ester, styrene-butadiene copolymers, acrylonitrile/butadiene copolymers, methyl acrylate/butadiene copolymers, acrylonitrile/butadiene acrylate copolymers and ethylene/vinylacetate copolymers.

Furthermore, in order to improve the thermosensitivity of the thermosensitive recording layer, a sensitizer can be added thereto. Specific examples of the sensitizer are as follows:

waxes such as N-hydroxymethyl-stearamide, stearamide and palmitamide;

naphthol derivatives such as 2-benzyloxynaphthalene;

biphenyl derivatives such as acetylbiphenyl, p-benzylbiphenyl and 4-allyloxybiphenyl;

polyether compounds such as 1,2-bis(3-methylphenoxy) ethane, 2,2'-bis(4-methylphenoxy)diethyl ether and bis(4-methoxylphenyl)ether; and derivatives of diesters of carbonate or oxalate such as diphenyl carbonate, dibenzyl oxalate and di(p-chlorobenzyl) oxalate.

Specific examples of the pigments for use in the thermosensitive recording layer are as follows; diatom earth, talc, kaolin, calcined kaolin, calcium carbonate, magnesium carbonate, titanium oxide, zinc oxide, silicon dioxide, aluminum hydroxide and urea/formalin resins.

An intermediate layer can be formed between the thermosensitive recording layer and the support to improve coloring property of the thermosensitive recording layer and to prevent a dust-adhered head problem in that a part of the thermosensitive recording layer adheres to the thermal printhead used for printing information in the recording layer, and thereby undesired white line images are formed in the resultant images. In addition, a protective layer can be formed on the thermosensitive recording layer to prevent an undesired coloring problem in that the recording layer is colored when contacted with an organic solvent, and to impart good water resistance to the recording layer.

Information can be recorded on the surface of the support (the face material) by various image forming methods such as thermal transfer recording, inkjet recording and printing, instead of the thermal recording mentioned above. Among these image forming methods, thermal recording methods are typically used because information can be recorded at a relatively low cost using a simple printer.

The adhesive layer of the second label sheets (i.e., the cut or semi-cut label sheets) are heat-activated and then the label sheets are attached to goods made of a material such as papers, plastics, metals, ceramics, woods, etc.

The label sheet issuing method of the present invention includes the following processes:

(1) detecting the timing marks printed on the backside of the first label sheet, i.e., on the thermosensitive adhesive layer;

(2) converting the detection signal to a cutting signal to cut or semi-cut the first label sheet; and (3) cutting or semi-cutting the first label sheet at a predetermined position according to the cutting signal.

As the detector configured to detect the timing marks, the controller configured to convert the detection signal to the cutting signal, and the cutter configured to cut or semi-cut the first label sheet, known devices can be used.

Specific examples of the detector include devices which can detect difference in light reflectance or light transmittance between the timing mark area and the non-mark area. Specific examples of the controller include computers. Specific examples of the cutter include known cutters which can cut or semi-cut (for example, perforate) labels. In this application, cutting means that the first label sheet is cut into plural second label sheets, and semi-cutting means that the first label sheet is imperfectly cut such that at least a part of the resultant plural second labels is connected to each other. Specific examples of semi-cutting include perforation and partial cutting.

In the label issuing method of the present invention, the position of the timing marks and the distance between the detecting position and the cutter are controlled such that the timing marks are not present at corners of the second label sheets. It is preferable that the ratio of the area of the timing mark in the second label sheet to the area of the second label sheet is from 0.5 to 35%, and preferably from 10 to 20%. Namely, the ratio is represented by the following equation:

$$R(\%)=(S1/S2)\times 100,$$

wherein R represents the ratio; S1 represents the area of the timing mark in the second label sheet; and S2 represents the area of the second label sheet.

Figure 1A:
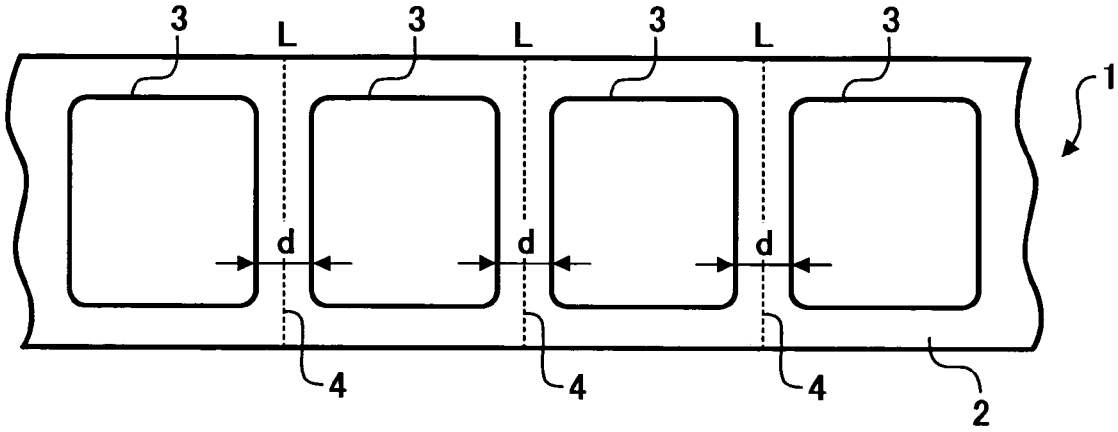
FIG. 1A BACKGROUND ART
FIGS. 1A and 1B are schematic diagrams illustrating a background label with a release paper (i.e., a first type of label sheet)
Figure 1B:
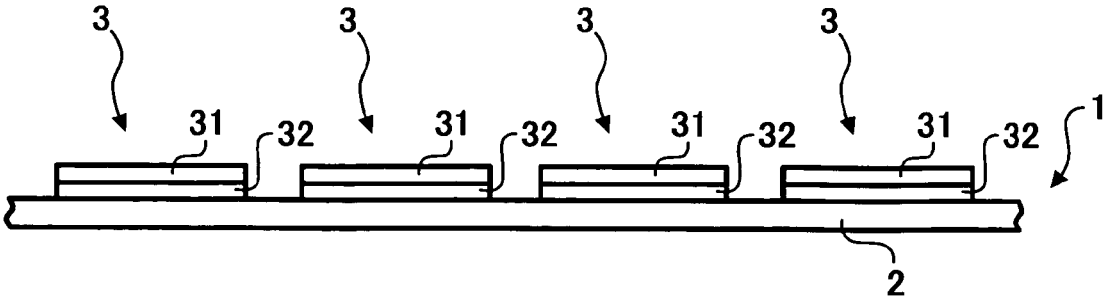
FIG. 1B BACKGROUND ART
Figure 2A:
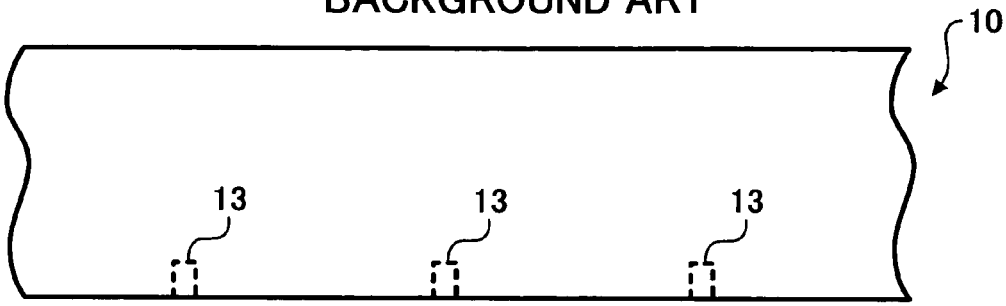
FIG. 2A BACKGROUND ART
FIGS. 2A to 2D are schematic diagrams illustrating a background second type of label sheet.
Figure 2B:
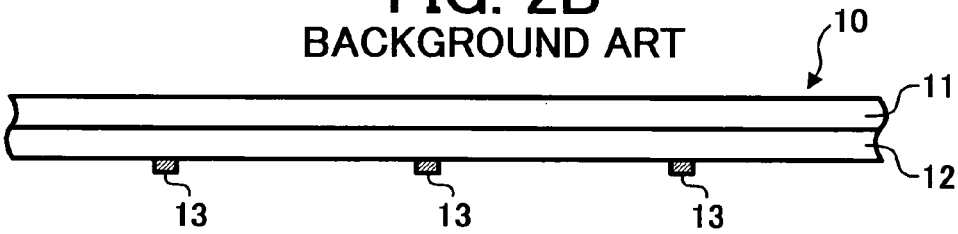
FIG. 2B BACKGROUND ART
Figure 2C:
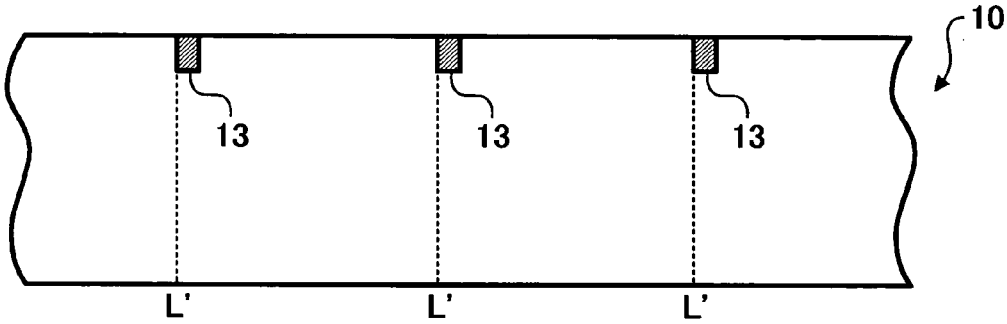
FIG. 2C BACKGROUND ART
Figure 2D:
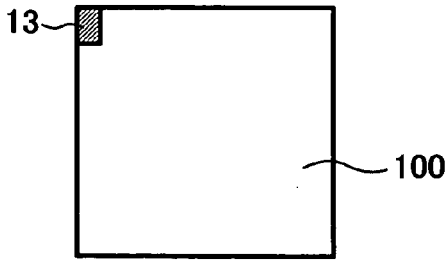
FIG. 2D BACKGROUND ART

In conventional methods for issuing label sheets, a timing mark is typically present at one corner of the second label sheet as illustrated in FIG. 2D. When such a second label sheet is heated to activate the thermosensitive adhesive layer thereof and adhered to a good, the corner of the second label sheet cannot be adhered to the good because the corner of the adhesive layer is not sufficiently activated due to the timing mark, and thereby the corner is peeled from the good. Such a label sheet looks unattractive, and in addition problems in that entire the label sheet is peeled from the good and the label sheet can be replaced with another label sheet to tamper with the information recorded in the labels sheet. By using the method of the present invention, such problems can be avoided.

In the second label sheet produced by the label issuing method of the present invention, the timing mark is preferably present at a position apart from the outer edge of the label sheet. Namely, the adhesive layer on which the timing mark is not present is present at the edge portions of the second label. By heat-activating such a second label sheet and adhering the label sheet to a good, the above-mentioned peeling problem is not caused because the adhesive layer at the edge portions can be sufficiently heat-activated and thereby the edge portions can be securely adhered to the good. The edge of the timing mark is preferably 5 to 15 mm apart from the nearest outer edge of the second label sheet. By heat-activating and adhering such second label sheets, the second label sheets can be securely adhered to goods without causing the peeling problem.

As mentioned above, the timing marks present on the adhesive layer side deteriorate the adhesive force of the thermosensitive adhesive layer when the adhesive layer is heated to be activated. By increasing the area of the timing marks, the timing mark detection can be securely performed, but the adhesive force of the heat-activated second label sheet deteriorates. By controlling the ratio of the area of the timing mark to the area of the second label sheet so as to fall in the range mentioned above, the second label sheet can be securely adhered to various goods without causing the timing mark mis-detection problem.

In the present invention, the timing marks are preferably formed by a printing method using an ultraviolet crosslinking ink or an electron beam crosslinking ink. The thus prepared timing marks can be well detected without causing the blocking problem in that the timing marks adhere to the support when the label sheet is rolled. In addition, even when a thermosensitive recording material is used as the support (i.e., a thermosensitive recording layer is formed on the surface of the support), the timing marks do not cause a coloring problem in that timing marks dissolve the coloring agent included in the recording layer, resulting in coloring of the recording layer. This coloring problem is caused when an oil ink is used for printing timing marks.

The form of the timing mark is not particularly limited, and various forms such as square forms, rectangular forms, oval forms, and cross forms can be available.

It is preferable that the ratio of the light reflectance of the timing mark area to that of the non-mark area is not less than 45%, and preferably not less than 55% against light in a wavelength range of from 880 to 920 nm. The light reflectance difference is defined as follows:

$$RL(\%)=(A-B),$$

wherein RL represents the light reflectance difference; A represents the light reflectance of the timing mark area; and B represents the light reflectance of the non-mark area.

In order to form timing marks such that the light reflectance ratio is not less than 45%, printing methods such as relief printing, planography, intaglio and stencil printing can be preferably used. Inks such as gravure inks, flexographic inks, ultraviolet crosslinking inks, electron beam crosslinking inks, offset inks and silk screen inks can be used. These inks typically include colorants (e.g., pigments and dyes), vehicles (e.g., oils, resins and solvents), and additives such as fluidity improving agents, dryers, film strength controlling agents, dispersants and wetting agents. As mentioned above, ultraviolet crosslinking inks and electron beam crosslinking inks are preferably used.

In order to form timing marks such that the light reflectance ratio is not less than 45% against light in a wavelength range of from 880 to 920 nm, the timing marks preferably include, as the colorant, a near infrared absorbing dye or pigment which has an absorption property such that a maximum absorption (λmax) is observed at a wavelength of from 800 to 1000 nm, and/or a white pigment which absorbs light having a wavelength of from 880 to 920 nm. By including such colorants in the timing marks, the resultant second label sheets can be securely adhered to goods without causing the non-detection problem and the peeling problem.

Specific examples of the near infrared absorbing dyes and pigments include the following compounds:

polymethine dyes such as a compound having the following formula (1):

(1)

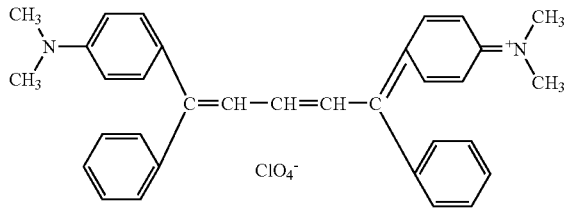

(λmax: 833 nm);

squarilium dyes such as a compound having the following formula (2):

(2)

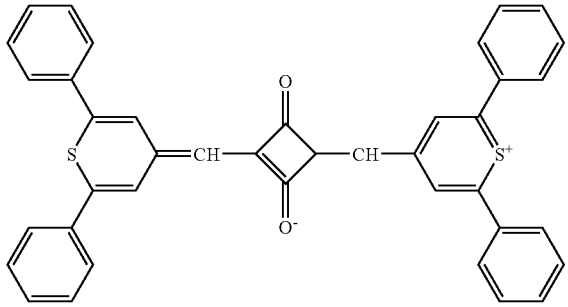

(λmax: 910 nm);

dithiol metal complexes such as compounds having the following formula (3):

(3)

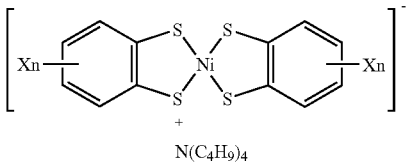

(λmax is 885 nm when Xn is $Cl_4$; and λmax is 925 nm when Xn is $(CH_3)_4$);

dithiolene metal complexes such as compounds having the following formula (4):

(4)

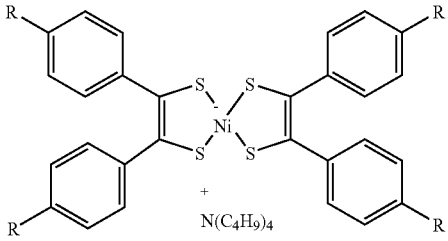

(λmax is 866 nm when R is H; λmax is 925 nm when R is $OCH_3$; and λmax is 925 nm when R is p-methoxyphenyl);

aminium dyes such as a compound having the following formula (5):

(5)

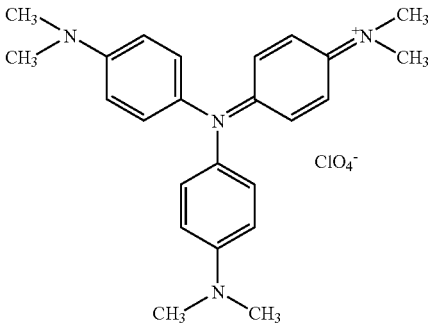

(λmax is 920 nm);

imonium dyes such as compounds having the following formula (6):

(6)

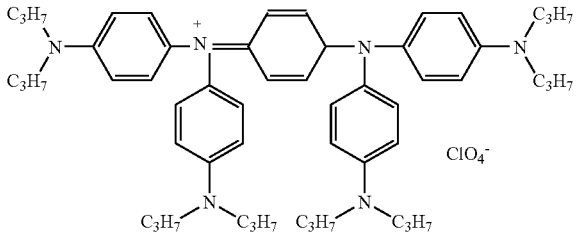

(λmax is 935 nm and 1475 nm)

(6')

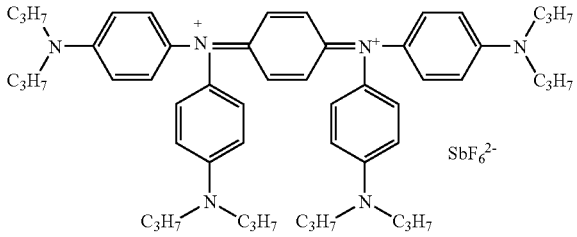

(λmax is 935 nm and 1475 nm)

phthalocyanine metal complexes such as compounds having the following formula (7):

(7)

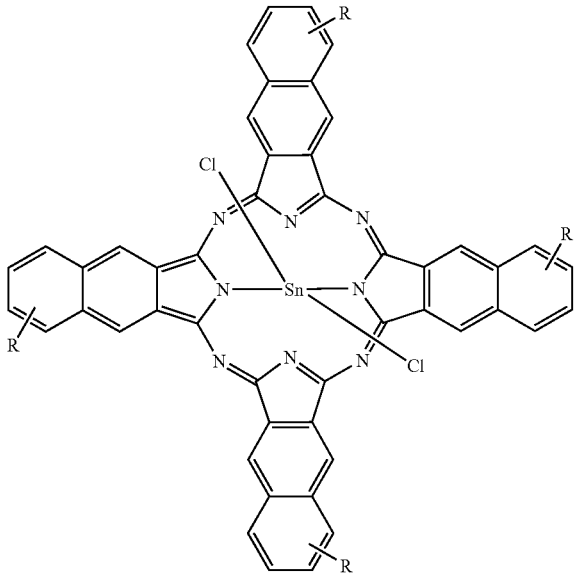

(λmax is 828 nm when R is H; and λmax is 829 nm when R is a tertiary butyl group).

Suitable pigments for use as the white pigment having absorption in a wavelength range of from 850 nm to 950 nm include electroconductive zinc oxides, electroconductive titanium oxides, electroconductive tin oxides, electroconductive indium oxides, etc.

Suitable materials for use as the vehicle of the ink used for printing timing marks include solvent-free ultraviolet crosslinking resins, and solvent-free electron beam crosslinking resins. When an ink including these resins as the vehicle is used, the ink is crosslinked only by being exposed to ultraviolet rays or electron beams, i.e., a drying process is not necessary. In addition, since the resultant timing marks do not cause the blocking problem, the roll of the first label sheet is easy to handle.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Thermosensitive Adhesive Layer (1) Preparation of Thermosensitive Adhesive Layer Coating Liquid Preparation of Solid Plasticizer Dispersion (A)

The following components were mixed.

| | |
|---|---|
| Parahydroxy benzoate (solid plasticizer) | 10 parts |
| 10% aqueous solution of polyvinyl alcohol (dispersant) | 10 parts |
| Water | 20 parts |

The mixture was subjected to a pulverization treatment using a ball mill so that the solid plasticizer has an average particle diameter of 1.0 μm. Thus, a solid plasticizer dispersion (A) was prepared.

Preparation of Thermosensitive Adhesive Layer Coating Liquid (B)

The following components were mixed while being agitated.

| | |
|---|---|
| Aqueous emulsion of silicone-modified urethane resin (solid content of 50%) | 5.0 parts |
| Solid plasticizer dispersion (A) | 24.0 parts |
| Emulsion of terpenephenol (solid content of 50%) | 2.0 parts |

Thus, a thermosensitive adhesive layer coating liquid (B) was prepared.

The silicone-modified urethane resin has a friction coefficient of about 0.07.

(2) Preparation of Thermosensitive Adhesive Layer

The thermosensitive adhesive layer coating liquid (B) was coated on one side of a support sheet having a width of 120 mm using a wire bar, followed by drying to prepare a thermosensitive adhesive layer having a thickness of 3.0 $g/m^2$ on a dry basis.

Formation of Thermosensitive Recording Layer (1) Preparation of Thermosensitive Recording Layer Coating Liquid Preparation of Dye Dispersion (E)

The following components were mixed.

| | |
|---|---|
| 3-dibutylamino-6-methyl-7-anilinofluoran (coloring agent) | 1.0 part |
| 10% aqueous solution of polyvinyl alcohol | 1.0 part |
| Water | 2.0 parts |

The mixture was subjected to a pulverization treatment using a sand grinder so that the coloring agent has an average particle diameter of 1.0 μm. Thus, a dye dispersion (E) was prepared.

Preparation of Color Developer Dispersion (F)

The following components were mixed.

| | |
|---|---|
| 4-hydroxy-4'-isopropoxydiphenylsulfone (color developer) | 3.0 parts |
| Silica | 1.0 part |
| 10% aqueous solution of polyvinyl alcohol | 4.0 parts |
| Water | 10.0 parts |

The mixture was subjected to a pulverization treatment using a sand grinder so that the solid components have an average particle diameter not greater than 3 μm. Thus, a color developer dispersion (F) was prepared.

Preparation of Thermosensitive Recording Layer Coating Liquid (G)

The following components were mixed while being agitated.

| | |
|---|---|
| Dye dispersion (E) | 4.0 parts |
| Color developer dispersion (F) | 18.0 parts |
| Water | 3.0 parts |

Thus, a thermosensitive recording layer coating liquid (G) was prepared.

(2) Preparation of Protective Layer Coating Liquid

Preparation of Silica Dispersion (H)

The following components were mixed.

| | |
|---|---|
| Silica | 1.0 part |
| 10% aqueous solution of polyvinyl alcohol | 4.0 parts |
| Water | 10.0 parts |

The mixture was subjected to a pulverization treatment using a sand grinder so that the silica has an average particle diameter not greater than 3.0 μm. Thus, a silica dispersion (H) was prepared.

Preparation of Protective Layer Coating Liquid (J)

The following components were mixed while being agitated.

| | |
|---|---|
| Silica dispersion (H) | 4.0 parts |
| 10% aqueous solution of polyvinyl alcohol | 10.0 parts |
| 30% aqueous dispersion of zinc stearate (Z-730 from Chukyo Yushi Co., Ltd.) | 1.0 part |
| 12.5% aqueous solution of polyamide epichlorohydrin | 3.2 parts |
| Water | 5.8 parts |

Thus, a protective layer coating liquid (J) was prepared.

(3) Preparation of Thermosensitive Recording Layer and Protective Layer

On the side of the support sheet opposite that bearing the thermosensitive adhesive layer, the thermosensitive recording layer coating liquid (G) and the protective layer coating liquid (J) were coated one by one and then dried to prepare a thermosensitive recording layer and a protective layer formed thereon. The weight of the dye in the thermosensitive recording layer was 0.5 g/m$^2$ on a dry basis and the coating weight of the protective layer was 3.5 g/m$^2$ on a dry basis. Then the support sheet was subjected to a calender treatment so that the smoothness of the surface of the protective layer is 2000 s.

Thus, a thermosensitive recording material with the thermosensitive adhesive layer on the backside thereof was prepared.

Blocking Test

Two sheets of the thus prepared label sheet were overlaid so that the protective layer of one sheet contacts the thermosensitive recording layer of the other sheet. Then the two sheets were preserved at 60° C. for 24 hours at a pressure of 2 kg/cm$^2$ under a dry condition. After the preservation, the two sheets were allowed to settle at room temperature and the sheets were peeled from each other to determine whether the two sheets caused the blocking problem.

As a result, the two sheets of the label sheet could be smoothly separated from the other, i.e., the label sheet did not cause the blocking problem.

Formation of Timing Marks

Timing marks were printed on the thermosensitive adhesive layer. The form of the printed timing marks and the area ratio of the timing marks are shown in Table 1.

Thus, a long label sheet of Example 1 which has a width of 120 mm and a length of 70 m, was prepared.

The long label sheet was set in a thermal printer having such a constitution as illustrated in FIG. 4 to produce second label sheets 100.

The conditions of the printer were as follows:

(1) image recording condition 1) thermal recording device 41: thermal printhead 2) recording energy: 16.0 mJ/mm$^2$ 3) recording pattern: flap pattern (2) heat-activating condition 1) heating device 46: thermal printhead 2) heating energy: 28.8 mJ/mm$^2$ 3) heating pattern: entire surface of the adhesive layer was heated.

Example 2

The procedure for preparation of the label sheet in Example 1 was repeated except that the form of the timing mark was changed to the timing mark as shown in the column of Example 2 in Table 1.

Thus, a label sheet of Example 2 was prepared.

Example 3

The procedure for preparation of the label sheet in Example 1 was repeated except that the form of the timing mark was changed to the timing mark as shown in the column of Example 3 in Table 1.

Thus, a label sheet of Example 3 was prepared.

Example 4

The procedure for preparation of the label sheet in Example 1 was repeated except that the form of the timing mark was changed to the timing mark as shown in the column of Example 4 in Table 1.

Thus, a label sheet of Example 4 was prepared.

Example 5

The procedure for preparation of the label sheet in Example 1 was repeated except that the form of the timing mark was changed to the timing mark as shown in the column of Example 5 in Table 1.

Thus, a label sheet of Example 5 was prepared.

Example 6

The procedure for preparation of the label sheet in Example 1 was repeated except that the form of the timing mark was changed to the timing mark as shown in the column of Example 6 in Table 1.

Thus, a label sheet of Example 6 was prepared.

Example 7

The procedure for preparation of the label sheet in Example 1 was repeated except that the form of the timing mark was changed to the timing mark as shown in the column of Example 7 in Table 1.

Then the long label sheet having a width of 120 mm and a length of 70 m was set in a printer having such a constitution as illustrated in FIG. 5 to produce second label sheets 200.

The conditions of the printer are as follows:

(1) image recording condition 1) thermal recording device 41: thermal printhead 2) recording energy: 16.0 mJ/mm$^2$ 3) recording pattern: flap pattern (2) heat-activating condition 1) heating device 46: thermal printhead 2) heating energy: 28.8 mJ/mm$^2$ 3) heating pattern: entire surface of the adhesive layer was heated.

Example 8

The procedure for preparation of the label sheet in Example 7 was repeated except that the ink used for printing the timing mark was changed to a black flexographic ink.

Example 9

The procedure for preparation of the label sheet in Example 7 was repeated except that the ink used for printing the timing mark was changed to a black ultraviolet crosslinking ink.

Comparative Example 1

The procedure for preparation of the label sheet in Example 1 was repeated except that the form of the timing mark was changed to the timing mark as shown in the column of Comparative Example 1 in Table 1.

Each of the thus prepared label sheets was evaluated as follows:

(1) Appearance of Adhered Label

The heat activated label was attached to a good. The attached label was visually observed to determine whether the label is securely adhered to the good. The appearance of the label adhered to the good was graded as follows:

○ (good): The label is securely attached without peeling or bulging.

Δ (fair): The corner of the label is slightly bulging but the appearance is still acceptable.

X (bad): The corner of the label is peeled from the good.

(2) Peeling Property of Attached Label

It was tried to peel the attached label to evaluate the peeling property of the label. The peeling property of the adhered label was graded as follows:

○ (good): The label was strongly attached to the good. When the label was forcibly peeled from the good, the label itself was broken.

Δ (fair): When the label was peeled from the food, a part of the label was broken or the adhesive layer remains on the good (i.e., the label could not be reused).

X (bad): The label could be clearly peeled from the good (i.e., the label could be reused, or a new label could be attached to amend the recorded information).

(3) Error Rate in Timing Mark Detection

The long label was continuously fed in the printer to produce 10,000 cut label sheets to determine the error rate in timing mark detection.

TABLE 1

| | Form of timing mark | Timing mark area ratio (%) | Appearance of attached label | Peeling property | Detection error rate (%) |
|---|---|---|---|---|---|
| Example 1 | 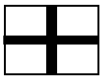 | 33.3 | Δ | Δ | 0.05 |
| Example 2 | 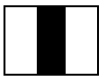 | 32.0 | ○–Δ | Δ | 0.06 |
| Example 3 | 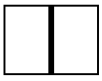 | 20.0 | ○–Δ | ○–Δ | 0.05 |
| Example 4 | 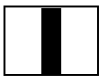 | 20.0 | ○ | ○–Δ | 0.07 |

TABLE 1-continued

| | Form of timing mark | Timing mark area ratio (%) | Appearance of attached label | Peeling property | Detection error rate (%) |
|---|---|---|---|---|---|
| Example 5 | 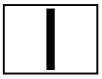 | 6.7 | ○ | ○ | 0.04 |
| Example 6 | 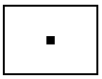 | 1.7 | ○ | ○ | 0.04 |
| Example 7 | 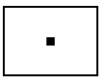 | 1.7 | ○ | ○ | 0.04 |
| Example 8 | 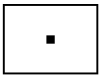 | 1.7 | ○ | ○ | 0.03 |
| Example 9 | 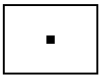 | 1.7 | ○ | ○ | 0.01 |
| Comp. Example 1 | 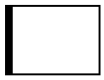 | 10.0 | X | Δ | 0.06 |

Examples 10–20 and Comparative Examples 2–4

Formation of Thermosensitive Adhesive Layer (1) Preparation of Thermosensitive Adhesive Layer Coating Liquid Preparation of Solid Plasticizer Dispersion (A)

The following components were mixed.

| | |
|---|---|
| 2-(3'-t-butyl-2'-hydroxy-5'-methylphenyl)-5-chlorobenzotriazole (solid plasticizer) | 5 parts |
| 2-(3',5'-di-t-butyl-2'-hydroxyphenyl)-5-chlorobenzotriazole (solid plasticizer) | 5 parts |
| 10% aqueous solution of polyvinyl alcohol (dispersant) | 10 parts |
| Water | 15 parts |

The mixture was subjected to a pulverization treatment using a ball mill so that the solid plasticizer has an average particle diameter of 1.0 μm. Thus, a solid plasticizer dispersion (K) was prepared.

Preparation of Supercooling Property Improving Agent Liquid

The following components were mixed.

| | |
|---|---|
| Di-p-methylbenzyl oxalate (supercooling property improving agent) | 10 parts |
| 10% aqueous solution of polyvinyl alcohol | 10 parts |

-continued

| | |
|---|---|
| (dispersant) | |
| Water | 15 parts |

The mixture was subjected to a pulverization treatment using a ball mill so that the supercooling property improving agent has an average particle diameter of 1.0 μm. Thus, a supercooling property improving agent dispersion (L) was prepared.

Preparation of Thermosensitive Adhesive Layer Coating Liquid (M)

The following components were mixed while being agitated.

| | |
|---|---|
| Solid plasticizer dispersion (K) | 400 parts |
| Emulsion of poly-2-ethylhexyl acrylate (solid content of 50%) | 100 parts |
| Dispersion of terpenephenol resin (solid content of 50%) | 50 parts |
| Supercooling property improving agent dispersion (L) | 50 parts |

Thus, a thermosensitive adhesive layer coating liquid (M) was prepared.

(2) Preparation of Thermosensitive Adhesive Layer

The thermosensitive adhesive layer coating liquid (M) was coated on one side of each of the support sheets which are described in Table 2 using a wire bar, followed by drying to prepare a thermosensitive adhesive layer. The coating weight was controlled so that the weight of the thermoplastic resin (i.e., poly-2-ethylhexyl acrylate) is 3.0 g/m$^2$ on a dry basis. Then the thermosensitive adhesive layer was cured for 12 hours under conditions of 24° C. and 65% RH.

Thus, rolls with a thermosensitive adhesive layer were prepared.

(3) Formation of Timing Mark

Preparation of UV Crosslinking Ink (for Examples 12–20 and Comparative Examples 3 and 4)

The following components were mixed to prepare an UV crosslinking ink.

| | |
|---|---|
| Solvent-free UV crosslinking resin (acrylic prepolymer) | 80 parts |
| Dye or pigment shown in Table 2 | 15 parts |
| Initiator for photo-polymerization | 4 parts |
| Stabilizer | |

Preparation of Thermosetting Ink (for Examples 10 and 11 and Comparative Example 2)

The following components were mixed to prepare a thermosetting ink.

| | |
|---|---|
| Dye or pigment shown in Table 2 | 12 parts |
| Melamine/formaldehyde resin | 30 parts |
| Trimethylol propane maleate | 26 parts |
| Trimethylol propane fumarate | 26 parts |
| Linseed oil | 2 parts |
| p-toluene sulfonate | 1.5 parts |

Printing of Timing Mark

Timing marks were printed on the thermosensitive adhesive layer of each label sheet at intervals of 50 mm using a relief printing resin plate, followed by a curing treatment (i.e., UV irradiation or heating). When the UV crosslinking ink was used, the timing marks were cured by an UV lamp of 120 W while being fed at a speed of 30 m/min. When the thermosetting ink was used, the timing marks were heated at a temperature not higher than 60° C. for 5 minutes. Thus, timing marks having a thickness of about 5 μm were printed.

TABLE 2

| | Support | Ink | Dye or pigment |
|---|---|---|---|
| Example 10 | Plain paper with a weight of 62 g/m$^2$ | Thermosetting ink | Dithiol metal complex having formula (3) |
| Example 11 | Receiving paper for thermal transfer recording | Thermosetting ink | Polymethine dye having formula (1) |
| Example 12 | Receiving paper for thermal transfer recording | UV crosslinking ink | Squarilium dye having formula (2) |
| Example 13 | Thermosensitive recording paper | UV crosslinking ink | Dithiolene metal complex having formula (4) |
| Example 14 | Thermosensitive recording paper | UV crosslinking ink | Aminium dye having formula (5) |
| Example 15 | Thermosensitive recording paper | UV crosslinking ink | Imonium dye having formula (6) |
| Example 16 | Thermosensitive recording paper | UV crosslinking ink | Phthalo-cyanine having formula (7) |
| Example 17 | Thermosensitive recording paper | UV crosslinking ink | Electro-conductive zinc oxide |
| Example 18 | Thermosensitive recording paper | UV crosslinking ink | Electro-conductive tin oxide |
| Example 19 | Thermosensitive recording paper | UV crosslinking ink | Electro-conductive titanium oxide |
| Example 20 | Thermosensitive recording paper | UV crosslinking ink | Electro-conductive indium oxide |
| Comp. Example 2 | Receiving paper for thermal transfer recording | Thermosetting ink | Carbon black |
| Comp. Example 3 | Thermosensitive recording paper | UV crosslinking ink | Phthalo-cyanine blue |
| Comp. Example 4 | Thermosensitive recording paper | UV crosslinking ink | Dithiol metal complex having formula (3) (3 parts)* |

*The addition quantity of the pigment was changed from 15 to 3 parts.

The thus prepared long label sheets were evaluated as follows:

(1) Adhesive Force

Each of the long label sheets was cut to prepare a rectangular label sheet of 4.0 cm wide and 15.0 cm long. The label sheet was heat-activated by a thermal printhead under the following conditions:

Energy applied to thermal printhead: 0.45 mJ/dot

Heating speed: 4 ms/line

Pressure of platen roller: 6 kgf/line

Environmental condition: 24° C. and 65% RH

The heat-activated label sheet was attached to a polyolefin wrapping film (from Mitsubishi Plastics, Inc.) while the label sheet was pressed by a rubber roller in the longitudinal direction of the label at a pressure of 2 kg.

The attached label sheet was peeled at an angle of 180° and at a speed of 300 mm/min to determine the adhesive force in units of gf/40 mm.

(2) Appearance of Attached Label

The attached label sheet prepared above in (1) was visually observed to determine whether the timing mark is noticeable from the front side of the label.

○ (good): The timing mark is not noticeable at all.

Δ (fair): The timing mark is slightly noticeable but is not an eyesore.

X (bad): The timing mark is so noticeable as to be an eyesore.

(3) Difference in Light Reflectance

The light reflectance of the timing mark area and the non-mark area in a near infrared region of from 880 to 920 nm was measured by a spectrophotometer UV-3100 manufactured by Hitachi Ltd., to determine the difference therebetween.

$$\text{Difference } (\%) = A - B,$$

wherein A represents the light reflectance of the non-mark area and B represents the light reflectance of the timing mark area.

(4) Timing Mark Detectability

Each of the long label sheets was set in a thermal label printer, UN400 manufactured by SATO CORP., and subjected to a feeding test to check whether the timing mark is detected and the label sheet is stopped at a predetermined position. The timing mark detectability was graded as follows:

○ (good): Mis-detection did not occur.

X (bad): Mis-detection occurred.

The results are shown in Table 3.

TABLE 3

| | Adhesive force (gf/40 mm) | Appearance | Reflectance difference (%) | Timing mark detectability |
|---|---|---|---|---|
| Example 10 | 2320 | ○ | 61.0 | ○ |
| Example 11 | 2260 | Δ | 49.5 | ○ |
| Example 12 | 2180 | ○ | 55.0 | ○ |
| Example 13 | 2300 | ○ | 58.5 | ○ |
| Example 14 | 2150 | ○ | 53.0 | ○ |
| Example 14 | 2090 | ○ | 57.0 | ○ |
| Example 16 | 2190 | Δ | 60.5 | ○ |
| Example 17 | 2230 | ○ | 55.5 | ○ |
| Example 18 | 2360 | ○ | 48.0 | ○ |
| Example 19 | 2140 | ○ | 52.5 | ○ |
| Example 20 | 2270 | ○ | 60.0 | ○ |
| Comp. Example 2 | 2280 | X | 90.0 | ○ |
| Comp. Example 3 | 2170 | Δ | 1.0 | X |
| Comp. Example 4 | 2200 | ○ | 30.5 | X |

Effect of the Present Invention

According to the label issuing method of the present invention, cut labels with a thermosensitive adhesive layer can be stably issued with hardly causing the detection problem. The labels can be easily heat-activated and can be adhered to various goods.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2003-018050 and 2003-418571, filed on Jan. 27, 2003, and Dec. 16, 2003, respectively, the entire contents of which are herein incorporated by reference.

What is claimed is:

1. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semi-cutting the first label sheet to produce a second label sheet, wherein the timing mark is present at a position other than corners of the second label sheet, wherein a ratio of an area of the timing mark to an area of the second label sheet is from 0.5 to 35%, and wherein a thermosensitive recording layer is formed overlying the other side of the support, said method further comprising:

heating the thermosensitive recording layer to record an image thereon before detecting the timing mark.

2. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semi-cutting the first label sheet to produce a second label sheet, wherein the timing mark is present at a position other than corners of the second label sheet, wherein a ratio of an area of the timing mark to an area of the second label sheet is from 0.5 to 35%, and wherein a thermosensitive recording layer is formed overlying the other side of the support, said method further comprising:

heating the thermosensitive recording layer to record an image thereon after detecting the timing mark and before cutting or semi-cutting the first label sheet.

3. A method for issuing a label, comprising:

feeding a first label sheet comprising a support and a thermosensitive adhesive layer located overlying one side of the support, wherein the first label sheet has a timing mark on the thermosensitive adhesive layer, said timing mark being located at a point apart from a side edge of said first label sheet;

detecting the timing mark; and cutting or semi-cutting the first label sheet along a line, to produce a second label sheet, such that said timing mark is located at a point apart from said line, wherein the timing mark is present at a position other than corners of the second label sheet, wherein a ratio of an area of the timing mark to an area of the second label sheet is from 0.5 to 35%, and wherein an outer edge of the timing mark is apart from an outer edge of the thermosensitive adhesive layer of the second label sheet.

4. The method according to claim 3, wherein the outer edge of the timing mark is at least 5 mm apart from a nearest outer edge of the thermosensitive adhesive layer.

5. The method according to claim 4, wherein the outer edge of the timing mark is at least 5 mm apart from a nearest side edge of the thermosensitive adhesive layer.

6. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semi-cutting the first label sheet to produce a second label sheet, wherein the timing mark is present at a position other than corners of the second label sheet, wherein a ratio of an area of the timing mark to an area of the second label sheet is from 0.5 to 35%, and wherein the timing mark is printed on the thermosensitive adhesive layer using at least one of ultraviolet crosslinking inks and electron beam crosslinking inks.

7. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semi-cutting the first label sheet to produce a second label sheet, wherein the timing mark is present at a position other than corners of the second label sheet, wherein a ratio of an area of the timing mark to an area of the second label sheet is from 0.5 to 35%, and wherein the thermosensitive adhesive layer comprises a silicone-modified thermoplastic resin and a solid plasticizer.

8. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semicutting the first label sheet to produce a second label sheet, wherein the timing mark is present at a position other than corners of the second label sheet, wherein a ratio of an area of the timing mark to an area of the second label sheet is from 0.5 to 35%, and wherein a difference in light reflectivity between a timing mark area and a non-mark area is not less than 45% in a wavelength range of from 880 nm to 920 nm.

9. The method according to claim 8, wherein the timing mark comprises a white pigment having an absorption at a wavelength of from 880 to 920 nm.

10. The method according to claim 9, wherein the white pigment is preferably selected from the group consisting of electroconductive zinc oxide, electroconductive titanium oxide, electroconductive tin oxide, and electroconductive indium oxide.

11. A method for issuing a label, comprising:

feeding a first label sheet comprising a support and a thermosensitive adhesive layer located overlying one side of the support, wherein the first label sheet has a timing mark on the thermosensitive adhesive layer;

detecting the timing mark; and cutting or semi-cutting the first label sheet to produce a second label sheet, wherein the timing mark is present at a position other than corners of the second label sheet, wherein a ratio of an area of the timing mark to an area of the second label sheet is from 0.5 to 35%, and wherein the timing mark comprises a near-infrared absorbing colorant having an absorption property such that a maximum absorption peak is present at a wavelength of from 800 to 1000 nm.

12. The method according to claim 11, wherein the near-infrared absorbing colorant is selected from the group consisting of polymethine dyes, squarilium dyes, dithiol metal complexes, dithiolene complexes, aminium dyes, imonium dyes, and phthalocyanines.

* * * * *